US011530088B2

(12) United States Patent
Neuhofer

(10) Patent No.: US 11,530,088 B2
(45) Date of Patent: Dec. 20, 2022

(54) BICYCLE TRANSPORT CONTAINER

(71) Applicant: Canyon Bicycles GmbH, Koblenz (DE)

(72) Inventor: Stefan Neuhofer, Koblenz (DE)

(73) Assignee: Canyon Bicycles GmbH, Koblenz (DE)

( * ) Notice: Subject to any disclaimer, the term of this patent is extended or adjusted under 35 U.S.C. 154(b) by 0 days.

(21) Appl. No.: 17/406,222

(22) Filed: Aug. 19, 2021

(65) Prior Publication Data

US 2022/0055824 A1 Feb. 24, 2022

(30) Foreign Application Priority Data

Aug. 20, 2020 (DE) ..... 20 2020 104 832.5

(51) Int. Cl.
*B65D 85/68* (2006.01)

(52) U.S. Cl.
CPC ..... *B65D 85/68* (2013.01); *B65D 2585/6862* (2013.01)

(58) Field of Classification Search
CPC ..... B65D 85/68; B65D 2585/6862
USPC ..... 206/335
See application file for complete search history.

(56) References Cited

U.S. PATENT DOCUMENTS

| | | | | |
|---|---|---|---|---|
| 3,929,225 | A | 12/1975 | Locke et al. | |
| 5,669,497 | A | 9/1997 | Evans et al. | |
| 10,144,578 | B2 | 12/2018 | Chen et al. | |
| 10,766,552 | B2 | 9/2020 | Keiller | |
| 2017/0066588 | A1* | 3/2017 | Schreiber | B65D 85/68 |
| 2018/0093819 | A1 | 4/2018 | Chen et al. | |
| 2018/0290820 | A1* | 10/2018 | Keiller | B65D 85/68 |
| 2020/0346848 | A1 | 11/2020 | Keiller | |
| 2021/0130082 | A1* | 5/2021 | Ku | B65D 85/68 |

FOREIGN PATENT DOCUMENTS

| | | | |
|---|---|---|---|
| DE | 202015102012 | U1 | 8/2015 |
| DE | 202017001043 | U1 | 7/2018 |
| DE | 202017001816 | U1 | 8/2018 |
| DE | 202018102422 | U1 | 9/2018 |
| DE | 202018104698 | U1 | 10/2018 |
| DE | 202018000945 | U1 | 7/2019 |
| DE | 102019201613 | A1 | 8/2019 |
| EP | 2239210 | B1 | 7/2013 |
| JP | S499393 | B1 | 3/1974 |
| WO | 2019124516 | A1 | 6/2019 |

* cited by examiner

*Primary Examiner* — Bryon P Gehman
(74) *Attorney, Agent, or Firm* — The Webb Law Firm

(57) ABSTRACT

A bicycle transport container includes an outer container which is designed so as to be in particular cuboidal. A frame retaining element is arranged inside the outer container. The frame retaining element can be taken out of the outer container, together with the bicycle frame. Since the frame retaining element includes a bottom side that is designed as a base, the frame retaining element can stand autonomously, independently of the outer container, together with the bicycle frame.

18 Claims, 4 Drawing Sheets

BICYCLE TRANSPORT CONTAINER

CROSS-REFERENCE TO RELATED APPLICATION

This application claims priority to German Patent Application No. 20 2020 104 832.5 filed Aug. 20, 2020, the disclosure of which is hereby incorporated by reference in its entirety.

BACKGROUND OF THE DISCLOSURE

The disclosure relates to a bicycle transport container, in particular a bicycle transport box.

DESCRIPTION OF RELATED ART

In order to transport bicycles, in particular to send bicycles via the parcel service, various bicycle transport containers are known. In particular, various bicycle transport boxes for shipping are known, which are in particular produced exclusively from cardboard.

SUMMARY OF THE DISCLOSURE

The object of the disclosure is that of providing a bicycle transport container in which a bicycle and in particular a bicycle frame can be reliably transported and/or from which it can be removed in a simple manner.

This object is achieved according to the disclosure by a bicycle transport container having the features as described herein.

The bicycle transport container according to the disclosure is in particular a bicycle transport box which, in a particularly preferred embodiment, is produced entirely from cardboard, wherein wear and/or carrying elements can be produced from plastics material. The bicycle transport container comprises an outer container, in particular an outer box. This is preferably designed so as to be cuboid. In order to remove the bicycle, in particular the bicycle frame or individual components of the bicycle, arranged in the outer container, the outer container comprises a removal opening. Said opening is preferably arranged on a narrow side or top side of the outer container, such that the contents of the bicycle transport container can be removed from the top in a simple manner.

According to the disclosure, a frame retaining element is arranged in the outer container. The frame retaining element carries a bicycle frame and, according to the disclosure, can be taken out of the outer container together with the bicycle frame. According to the disclosure, a bottom side of the frame retaining element is designed as a base. It is thus possible to erect the frame retaining element, together with the bicycle frame carried by the frame retaining element, independently of the outer container. It is thus possible to remove the bicycle frame, together with the frame retaining element, from the outer container, in particular upwards, and for example place it beside the outer container. This prevents the bicycle frame, taken out of the outer container, from falling over or having to be lent up. This is of particular interest in particular in the case of a premium bicycle frame, in order to prevent damage.

The frame retaining element preferably comprises a base element, the bottom side of which forms a base. The bottom side of the base element is in particular designed so as to be flat. The base element preferably has a rectangular cross section, wherein the width is preferably in the range of from 15 cm to 25 cm, and the length is in the range of from 120 cm to 150 cm, in order to ensure reliable standing.

It is furthermore preferable for the outer dimensions of the in particular rectangular base element to substantially correspond to the inner dimensions of the outer container. In this case, the dimensions preferably substantially correspond to the inner dimensions of the footprint of the outer container. The base element of the frame retaining element can thus be arranged in the outer container such that it does not slip laterally and in the longitudinal direction, in the outer container.

In a particularly preferred embodiment of the frame retaining element, said element comprises a chainstay fixing element and/or a fork fixing element. The chainstay fixing element and/or the fork fixing element serve for receiving or for connection to the fork and/or the chainstay of a bicycle frame.

It is particularly preferable for the chainstay fixing element and/or the fork fixing element to be rigidly connected to the base element. It is particularly preferable for the chainstay fixing element and/or the fork fixing element to be formed integrally with the base element and in particular to be produced from cardboard. It is particularly preferable for in particular the entire frame retaining element to be produced from a flat cardboard blank, by corresponding folding.

In a particularly preferred development of the disclosure, the chainstay fixing element comprises two side parts which are arranged so as to be substantially perpendicular to the base element. In particular, the two side parts are thus oriented so as to be mutually parallel, and are in particular arranged opposite one another. It is particularly preferable for the two side parts to be interconnected by means of a reinforcing part. In this case, it is preferable for the reinforcing part to extend substantially in parallel with the base element. The chainstay of the bicycle frame is preferably fastened or fixed to the side parts of the chainstay fixing element. It is thus possible to fix the chainstay, by means of the chainstay fixing element, at a distance from the base element. As a result, the risk of damage to the bicycle frame during transport is significantly reduced.

The chainstay of the bicycle frame is preferably connected to the chainstay fixing element in the region of dropouts. In this case, the connection takes place, in a preferred embodiment, such that in the case of a frame retaining element arranged in the outer container, there is a spacing between the dropouts and a side wall of the outer container, such that the risk of damage during transport is further reduced.

It is particularly preferable for the fixing of the chainstay to the chainstay fixing element to be achieved using a fixing element. The fixing element is preferably a quick-release axle. In particular, the quick-release axle can be inserted into the dropouts of the chainstay. In this case, it is particularly preferable for the quick-release axle to be used which bears the rear wheel hub in the mounted state.

In a particularly preferred development, the chainstay fixing element comprises openings for receiving the fixing element, in particular for receiving the quick-release axle. In this case, it is particularly preferable for the corresponding openings to be arranged opposite one another in the two side parts, such that in particular the quick-release axle can be pushed through said openings and fixed in the corresponding dropouts of the chainstay. It is furthermore preferable for a plurality of such openings to be provided, such that the chainstay of the bicycle frame can be connected to the chainstay fixing element in different positions. This is advantageous in that different frame sizes can be connected to the same chainstay fixing element, and it is not necessary to keep a plurality of chainstay fixing elements for different frame sizes.

In a particularly preferred development of the disclosure, the fork fixing element is designed in a manner similar to the chainstay fixing element, and therefore in particular has the advantages described above with reference to the chainstay fixing element.

In particular, the fork fixing element comprises two side parts which are arranged substantially perpendicularly to the base element. The two side parts are preferably interconnected via a reinforcing part which in particular extends in parallel with the base element. It is furthermore preferred for the dropouts of the bicycle fork to be connected to the fork fixing element. In a preferred embodiment, this can take place in a manner corresponding to the fixing of the chainstay using a fixing element, such as a quick-release axle. In this case, it is particularly preferable to also provide openings in the fork fixing element, into which openings the fixing element, in particular the quick-release axle, can be inserted. In this case, the openings are again preferably arranged in the two side parts, such that the quick-release axle can be inserted through said openings and fixed in the dropouts of the bicycle fork.

In a preferred development of the disclosure, the fork fixing element comprises a further recess for receiving a seat post. The recess is in particular provided in the side parts of the fork fixing element. The seat post can thus be arranged in the fork fixing element, in particular transversely to the longitudinal direction of the frame retaining element. The longitudinal direction of the frame retaining element corresponds to the longitudinal or travel direction of the bicycle frame arranged in the frame retaining element. Instead of providing a recess of this kind in the fork fixing element, said recess can also be provided in the chainstay fixing element.

Since the frame retaining element preferably serves for fixing the bicycle frame without mounted wheels, the shipping of the bicycle frame can take place without wheels. It is preferable for the wheels to also be arranged inside the outer container, in a wheel container, in particular a wheel box. In this case, it is particularly preferable for a separate wheel container to be provided per wheel, in order to prevent damage to the wheels. Furthermore, providing a second separate wheel container makes it possible to arrange this on a different side of the bicycle frame in each case. The wheel container is preferably designed such that it completely surrounds the wheel. The box can comprise a slit or an opening, such that for example a brake disc connected to the wheel is arranged outside the box. This is used at the same time for fixing the wheel in the wheel container. Optionally, the brake disc can be surrounded by a separate protective element in order to prevent damage to the brake disc or to the bicycle frame by the brake disc during transport.

In a further preferred embodiment, the bicycle frame is pre-mounted such that the handlebars are connected to the steer tube. In the case of a design of this kind, it is preferable for a handlebar protector to be arranged inside the outer container. Said protector is preferably designed such that it is suitable as protection for triathlon handlebars. It is preferable for the handlebar protector to be made from cardboard. The handlebar protector preferably comprises a cover element which is arranged substantially above the handlebars. Thus, when the box is closed, the cover element is arranged between the handlebars and a lid of the outer container. In particular, the lid element is thus arranged on a top side of the handlebars. It is furthermore preferable for the lid element to comprise a longitudinal slit for receiving a central cross piece of the bicycle handlebars, in particular of the triathlon handlebars.

In a particularly preferred embodiment of the handlebar protector, a connection element is provided between the cover element and the base element. In particular, the connection element is connected to the cover element and is preferably formed in one piece. It is furthermore preferred for the connection element to comprise two connection parts, wherein one of the connection parts, in each case, is arranged laterally beside the fork fixing element. The connection element thus additionally serves to stabilize the entire bicycle transport container. The connection element, in particular the two connection parts, is/are preferably inserted into an in particular slit-shaped recess provided in the base element.

BRIEF DESCRIPTION OF THE DRAWINGS

The disclosure will be explained in greater detail in the following on the basis of a preferred embodiment, with reference to the accompanying drawings, in which.

DETAILED DESCRIPTION

Figure 1:
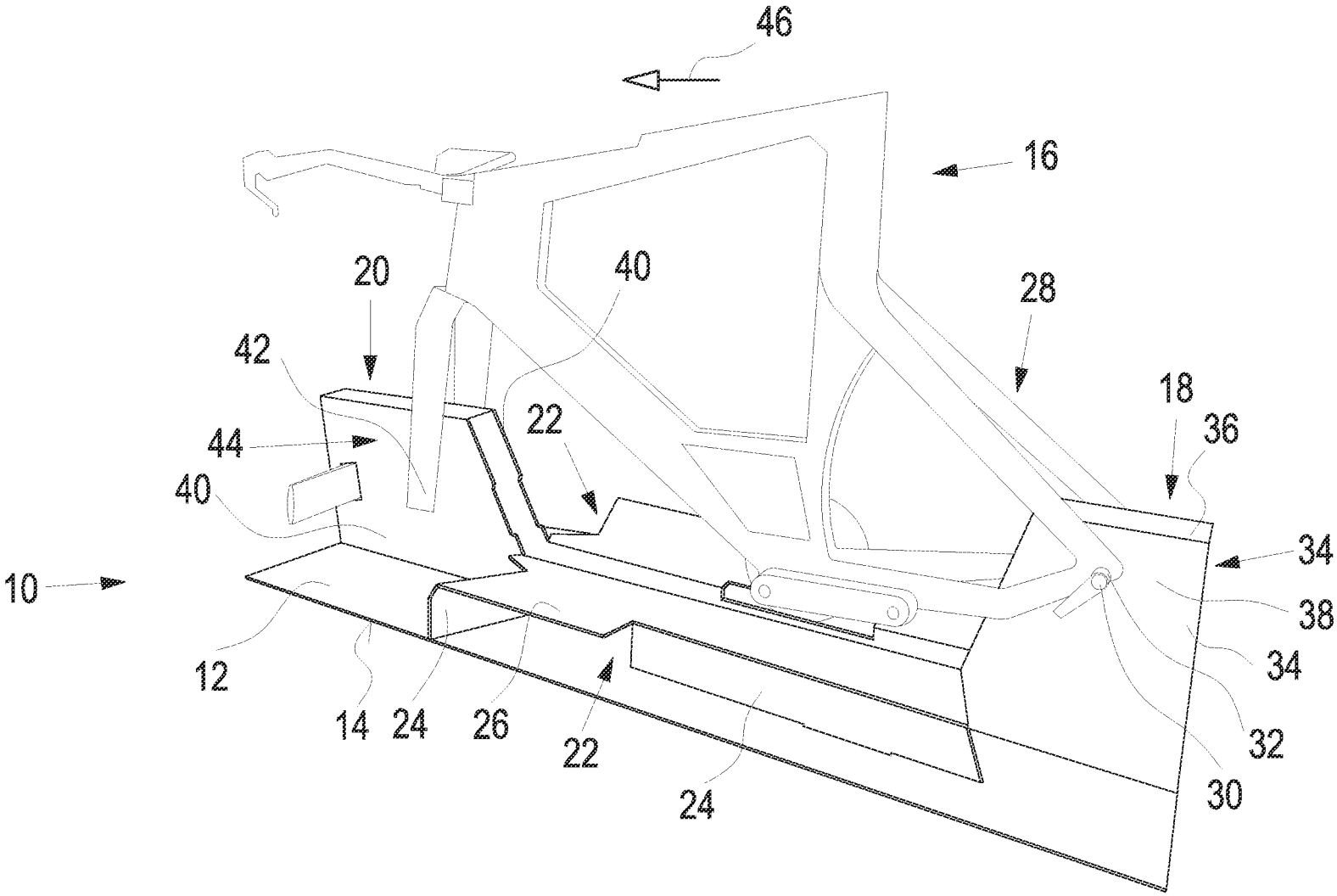
FIG. 1 is a schematic perspective side view of the frame retaining element together with a bicycle frame.
Figure 2:
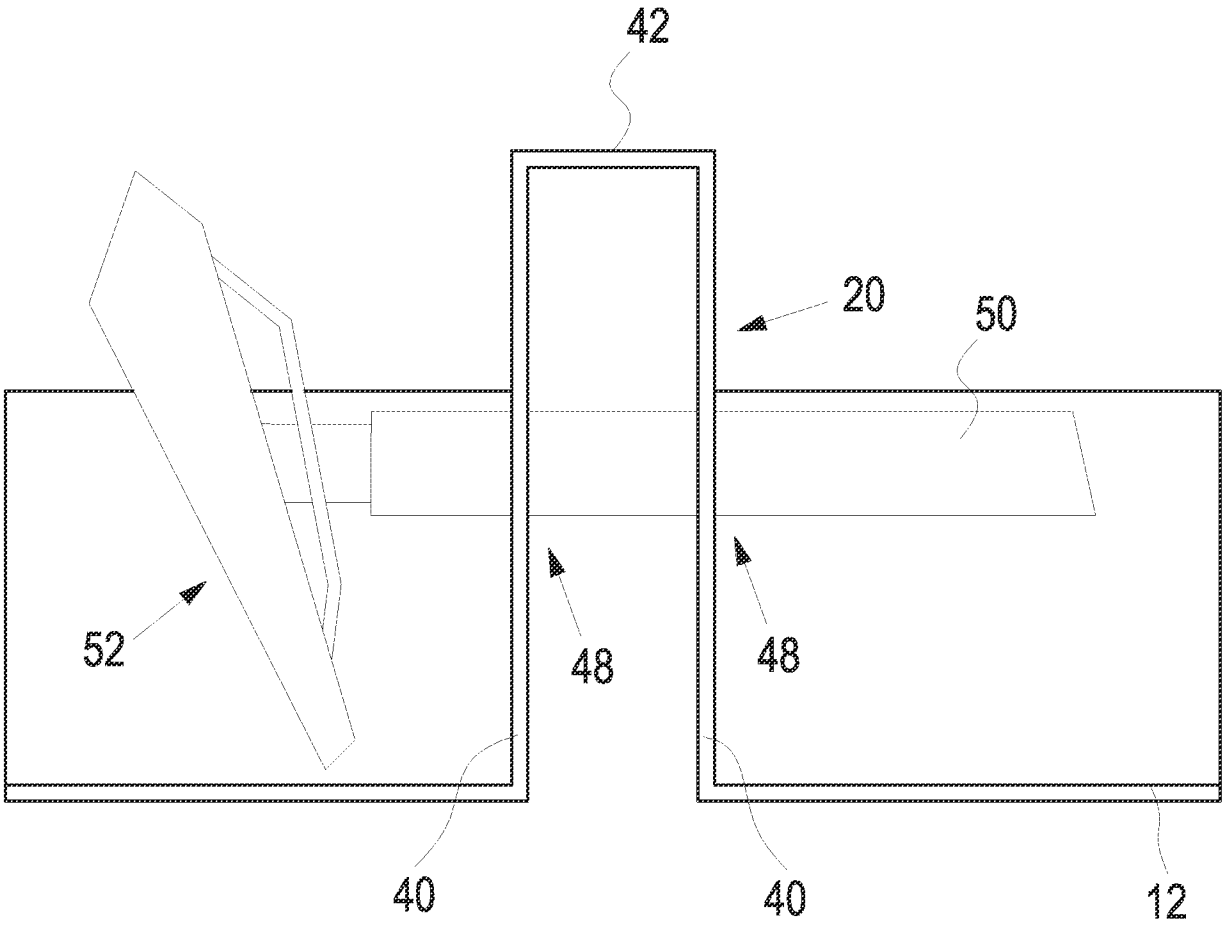
FIG. 2 is a schematic front view of the fork fixing element.

A frame retaining element 10 is preferably produced from cardboard, and in particular produced from a single cardboard blank, by means of folding. The frame retaining element 10 comprises a base element 12. A bottom side 14 of the base element 12 is designed so as to be flat and serves as a base, such that, as shown in FIG. 1, a bicycle frame 16 retained by the frame retaining element 10 can be erected autonomously and stands freely.

The frame retaining element 10 comprises a chainstay fixing element 18 and a fork fixing element 20. The two fixing elements 10, 20 are connected to the base element 12, in particular formed integrally therewith. The frame retaining element furthermore comprises reinforcing elements 22. The reinforcing elements 22 are arranged on the top side of the base element 12 and comprise, on one side, walls 24 which are arranged perpendicularly to the top side of the base element 12 and are connected to, in particular formed integrally with, a wall element 26 oriented in parallel with the base element 12.

The bicycle frame 16 which, in the exemplary embodiment shown, is a triathlon frame, comprises a chainstay 28. The chainstay 28 is retained on the chainstay fixing element 18 by means of a quick-release axle 30. In this case, the quick-release axle 30 is guided through and/or fixed in openings provided at the dropouts 32 of the chainstay 28. The fixing takes place in a manner corresponding to the fixing of the rear wheel hub, using the quick-release axle 30. In this case, the quick-release axle 30 is pushed through openings. Said openings are provided in the two mutually opposing side parts 34 of the frame retaining element 18. The two side parts 34 are arranged so as to be substantially perpendicular to the base element 12 and are interconnected via a reinforcing part 36 which extends in parallel with the base element 12.

Further mutually opposing openings 38 can be provided in the two side parts 34, such that frames of different sizes can be connected to the same frame retaining element, in particular the same chainstay fixing element 18.

In the embodiment shown, in a manner corresponding to the chainstay fixing element 18 the fork fixing element 20 comprises two side parts 40 which likewise extend in parallel with one another and perpendicularly to the top side of the base element 12. At the top end, the two side parts 40 are interconnected via a reinforcing part 42. An opening is arranged, in each case, in the two side parts 40, such that a quick-release axle 42, which serves for fixing the front wheel hub, is arranged at the dropouts of the steer tube in the corresponding recesses and can be pushed through the openings in the side parts 40. As a result, the front wheel fork 44 is also rigidly connected to the two fixing elements 18, 20, in a manner corresponding to the chainstay 28 of the bicycle frame 16.

A further recess 48 can be provided in the two side parts 40, in front of the bicycle fork 44 in the longitudinal direction 46 of the bicycle transport container or in the frame longitudinal direction. A seat post 50 can be inserted into said opposing recesses 48, which post bears a saddle 52.

Figure 3:
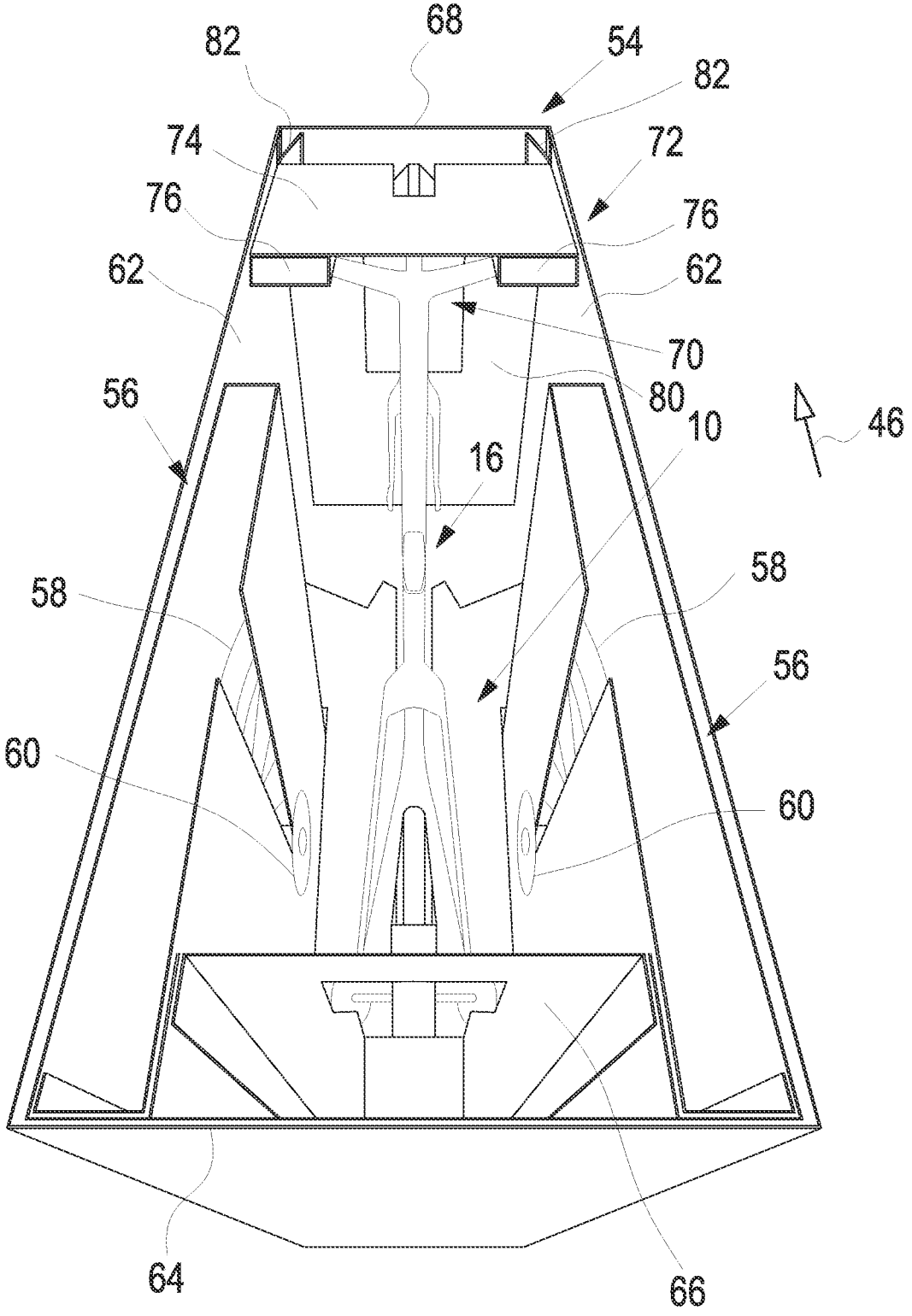
FIG. 3 is a schematic perspective plan view of the outer container, together with a frame retaining element arranged inside the outer container, as well as wheel containers.
Figure 4:
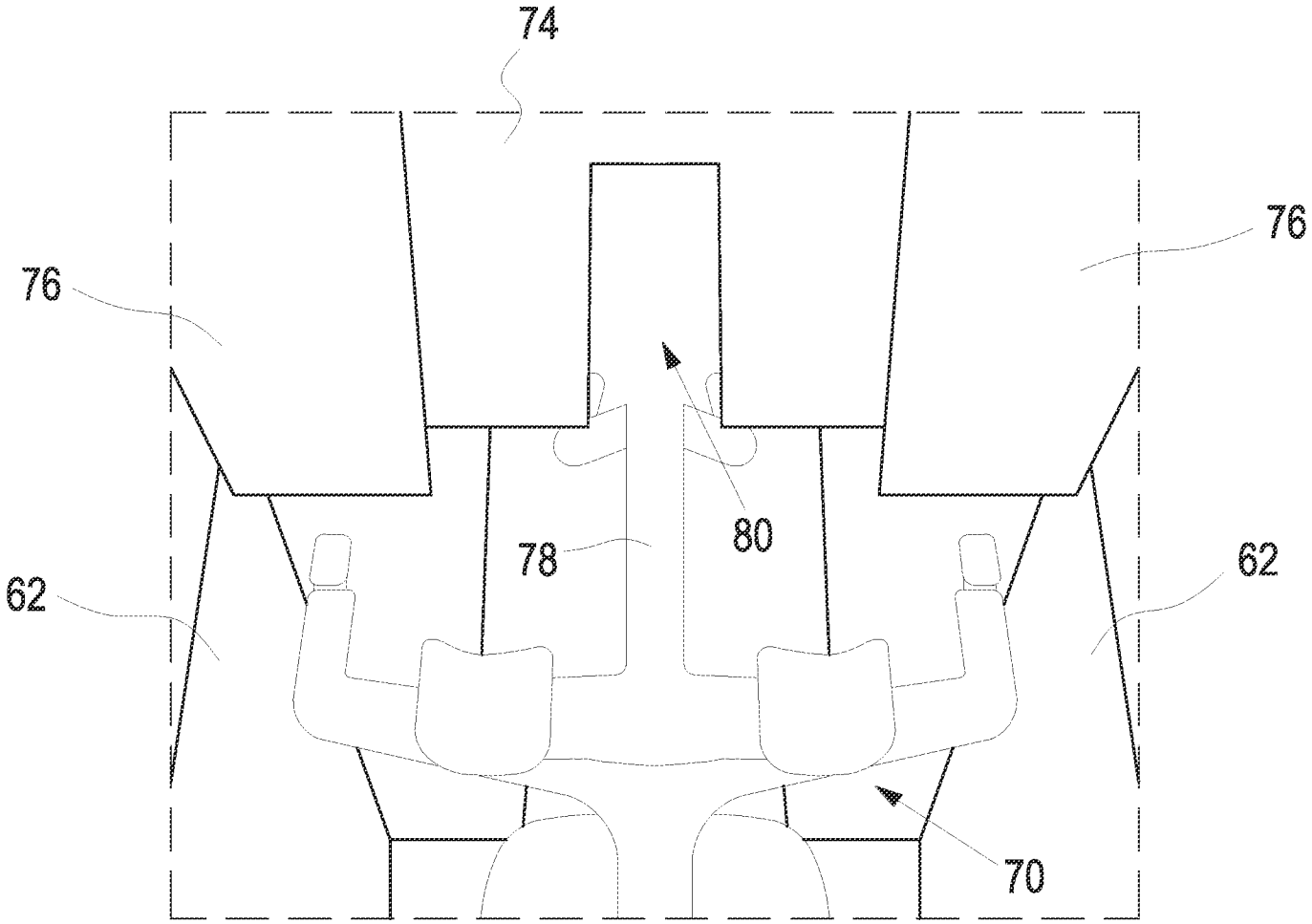
FIG. 4 is a schematic perspective view of the region of the bicycle transport container in which the handlebars are arranged.

The frame retaining element 10 is arranged in an outer container, in particular an outer box 54 (FIG. 3). The outer container 54 is cuboidal and has a width of which the inner dimension substantially corresponds to the width of the base element 12. Accordingly, the length of the outer container 54 extending in the longitudinal direction 46 has an inner dimension that is such that it corresponds to the dimensions in the longitudinal direction 46 of the base element 12. Two wheel containers 56 are also arranged inside the outer container, laterally beside the bicycle frame 16. The wheel containers 56 each enclose a wheel 58, wherein the wheel containers 56 comprise vertically extending slits, such that the wheels 58 in FIG. 3 can be inserted into the wheel containers 56 from above. The brake discs 60 which are connected to the hubs are arranged outside of the wheel container 56.

The two wheel containers 56 are resting on the two mutually opposing side walls 62 of the outer container, on the inside thereof. A spacer element 66, which is preferably likewise produced from cardboard, is arranged in the region of a transverse wall 64 of the outer container 54. The spacer element 66 is arranged in the region of the chainstay fixing element 18 and overlaps this, preferably such that parts of the spacer element 66 are arranged laterally beside the chainstay fixing element 18. The spacer element 66 can be used for receiving further individual parts, in operating instructions and the like. Furthermore, the spacer element 66 ensures that the brake discs 60 do not contact the bicycle frame 16.

A transverse wall 68 is provided on a side of the outer container 54 opposite the transverse wall 64. In this region, in which handlebars 70, which are connected to the bicycle fork 44, are provided, a handlebar protector 72 is arranged. The handlebar protector 72 comprises a cover element 74 which is arranged above the bicycle handlebars, wherein two side parts 76 of the cover element 74 rest on the top side of the handlebars which are designed as triathlon handlebars.

The handlebars 70 comprise a handlebar central cross piece 78. This can be arranged in a recess 80 of the lid element 74.

A connection element 80 which extends substantially in parallel with the transverse wall 78 of the outer container 54 is connected to the handlebar protector 72. Said connection element comprises two connection parts which are arranged laterally beside the fork fixing element 20. Furthermore, two spacer elements 82 which extend in parallel with the two side walls 62 are connected to the handlebar protector 72.

What is claimed is:

1. A bicycle transport container, comprising an outer container, a frame retaining element which is arranged in the outer container and can be taken out of the outer container together with a bicycle frame that is carried by the frame retaining element, and a handlebar protector arranged in the outer container and comprising a lid element arranged above the handlebar, wherein a bottom side of the frame retaining element forms a base such that the frame retaining element stands autonomously, independently of the outer container, together with the bicycle frame carried by the frame retaining element.

2. The bicycle transport container according to claim 1, wherein the frame retaining element comprises a base element, the bottom side of the frame retaining element forming the base.

3. The bicycle transport container according to claim 2, wherein outer dimensions of the base element substantially correspond to inner dimensions of the outer container in a region in which the frame retaining element is arranged.

4. The bicycle transport container according to claim 1, wherein the frame retaining element comprises a chainstay fixing element and a fork fixing element.

5. The bicycle transport container according to claim 4, wherein the chainstay fixing element and the fork fixing element is rigidly connected to a base element.

6. The bicycle transport container according to claim 4, wherein the chainstay fixing element comprises two side parts which are arranged perpendicularly to a base element.

7. The bicycle transport container according to claim 4, wherein the chainstay fixing element is connected to the bicycle frame in the region of dropouts of a chainstay of the bicycle frame.

8. The bicycle transport container according to claim 4, wherein the chainstay fixing element is connected to the bicycle frame via a fixing element.

9. The bicycle transport container according to claim 4, wherein the chainstay fixing element comprises an opening for receiving the fixing element.

10. The bicycle transport container according to claim 9, wherein a plurality of recesses for fixing bicycle frames of different sizes are provided in the chainstay fixing element.

11. The bicycle transport container according to claim 4, wherein the fork fixing element comprises two side parts which are arranged perpendicularly to the base element.

12. The bicycle transport container according to claim 4, wherein the fork fixing element is connected to the bicycle frame in the region of dropouts of a fork of the bicycle frame.

13. The bicycle transport container according to claim 4, wherein the fork fixing element is connected to the bicycle frame via the fixing element.

14. The bicycle transport container according to claim 4, wherein the fork fixing element comprises an opening for receiving a fixing element.

15. The bicycle transport container according to claim 4, wherein the fork fixing element comprises a recess for receiving a seat post.

16. The bicycle transport container according to claim 1, wherein wheel containers are arranged in the outer container.

17. The bicycle transport container according to claim 1, wherein the lid element comprises a longitudinal slit for receiving a handlebar central cross piece.

18. The bicycle transport container according to claim 1, wherein the handlebar protector comprises a connection element between the lid element and a base element of the frame retaining element, which the connection element comprises two connection parts which are in each case arranged laterally beside the fork fixing element.

* * * * *